US005656002A

United States Patent [19]

Dittmeier

[11] Patent Number: 5,656,002

[45] Date of Patent: Aug. 12, 1997

[54] STRETCHING ROPE WITH FOOTBED

[75] Inventor: Paul J. Dittmeier, 460 Brannon St., San Francisco, Calif. 94107

[73] Assignee: Paul J. Dittmeier, San Francisco, Calif.

[21] Appl. No.: 494,711

[22] Filed: Jun. 26, 1995

Related U.S. Application Data

[63] Continuation-in-part of Ser. No. 344,845, Nov. 25, 1994, abandoned.

[51] Int. Cl.[6] ..... A63B 21/002

[52] U.S. Cl. ..... 482/91; 482/114

[58] Field of Search ..... 482/21, 91, 108, 482/74, 907, 82, 83, 114, 140, 81

[56] References Cited

U.S. PATENT DOCUMENTS

| | | | |
|---|---|---|---|
| 2,869,872 | 1/1959 | Nissen | 482/82 |
| 4,293,125 | 10/1981 | Hinds | 482/82 |
| 4,335,875 | 6/1982 | Elkin | 482/74 |
| 4,563,002 | 1/1986 | Jardine | 482/82 |
| 4,664,373 | 5/1987 | Hait | 482/108 |
| 4,691,917 | 9/1987 | Battista | 482/74 |
| 5,004,228 | 4/1991 | Poners | 482/907 |
| 5,230,679 | 7/1993 | Olsen | 482/91 |

*Primary Examiner*—Stephen R. Crow

[57] ABSTRACT

Stretching rope specifically designed to facilitate the user in positioning and holding a stretch in a specific position for a set period of time. The stretching rope construction includes a pliable, elastomeric footbed which provides the user with comfortable secure positioning of the stretch rope on and around the foot, feet and lower leg area during stretching exercises.

2 Claims, 1 Drawing Sheet

STRETCHING ROPE WITH FOOTBED

This application is a continuation-in-part of application Ser. No. 08/344,845, filed Nov. 25, 1994, now abandoned.

BACKGROUND OF THE INVENTION

1. Field of Invention

This invention pertains to the general field of stretching and more particularly to the stretching technique known as active isolated stretching.

2. Description of Prior Art

Active isolated stretching is a relatively new stretching technique which until recently has been practiced only by physical therapists and sports coaches. A broader awareness and acceptance of this stretching technique and its benefits has grown tremendously over the last two years. Recent articles in sport magazines which feature active isolated stretching have contributed to this awareness. As a result active isolated stretching is being practiced more commonly in health clubs, sports programs, and at home. Articles discussing the benefits of this new stretching technique have been featured in American Health magazine (September 1994), Runner's World magazine (February 1994), and Women's Sports & Fitness magazine (August 1994). When compared to conventional stretching techniques active isolated stretching provides the user with greater flexibility, a reduction in sports related injuries and allows the body to move more efficiently. The scope of this invention discloses a device designed specifically to address the needs of this new stretching technique.

One of the main elements of active isolated stretching involves isolating and stretching specific muscles by contracting muscles opposite to the identified muscles being lengthened or stretched. The contracting muscles move the opposite muscle group into a stretched or lengthened position. The muscle group is then held in the stretched position for a period of 1–2 seconds and then released.

To enhance the results of active isolated stretching technique the use of a rope around the users foot, feet, hands and lower leg area can be employed to assist the muscles being stretched. When the muscles are stretched by contracting opposing muscles to move them into a stretched position a rope is placed on the users foot, feet, hand, or lower leg area which is then pulled by the user to further move and stretch the targeted muscles to the point of light irritation for 1–2 seconds. All muscles have an inherent stretch reflex response which is activated when a muscle is held in a stretched position for more than 2–3 seconds. This is the body's natural defense of preventing stretching injuries. When this stretch reflex response is activated the stretched muscle is sent a signal to contract which can cause muscle soreness or muscle tissue tearing. For conventional stretching techniques such as static stretching the muscles are held for 30 to 60 seconds which can came muscle injury.

When the use of a rope is employed to assist in active isolated stretching, the rope is placed around the base of the foot, feet or lower leg region and is pulled by the user's hands to perform a variety of stretches. Each muscle area or group being stretched usually involves 2 sets each comprising 8–12 repetitions.

One of the main problems in using a plain unmodified single length of rope for active isolated stretching is a general tendency for the rope to roll out of position or completely off the body when pressure is applied. When this occurs the stretch must be interrupted to reposition the rope.

The other major difficulties with a plain rope is that the pressure of the rope on the base of the foot causes the user to experience discomfort and pain in area of contact on the body during the stretch. For some stretches the rope is placed around the base of the foot and wrapped around the lower part of the leg. When the user tries to wrap the rope around the leg there is a tendency for the rope to slide around or off the base of the foot due to the ropes round smooth surface. In addition the user will experience discomfort where the rope is contacting the skin under pressure when pulled by the user.

In view of the above deficiencies, the object of the invention is to provide a stretching device for assisting in active isolated stretching where said stretching device can be easily positioned, is comfortable to use, remains in the desired position during the stretch, and remains in stable contact against the users skin when pulled against the foot, feet or lower leg area.

There are many types of stretching aids which have been designed for various forms of stretching but they do not properly address the specific needs of the user practicing active isolated stretching. A single rope can be used but is not practical because of the movements of the rope during use and the pain it causes during use when pressure is applied.

In U.S. Pat. No. 5,230,679 (1993) Olsen describes a device for moving or repositioning a leg that has been immobilized by injury. The design of the Olsen device is made up of a single length of firm tubing which does not stretch or compress. Olsen states that the tubing used in the invention has enough rigidity to support its own weight so it can be lifted as a complete unit. The Olsen invention would not be practical for active isolated stretching because it could not be properly positioned and wrapped around the users lower leg area which is required for some of the stretches due to its rigid properties. Furthermore the Olsen invention would be far to costly to manufacture as it requires an inner and outer tube construction with a non slip material glued or wrapped around the outside of the foot tube. Due to the forces applied to the footbed device for active isolated stretching the glued or wrapped non slip material in the Olsen invention would encounter durability problems.

In U.S. Pat. No. 4,664,378 (1987) Hait discloses an exercise device that uses a padded sleeve made from an inner plastic or rubber material which is covered or encircled by a cylindrical fabric cover. This padded sleeve would not be suitable for the active isolated stretching footbed material because it would not posses the mechanical properties for it to flex and compress to provide comfort to the users contact skin area. The padded comfort for the Hair invention is achieved by a separate fabric cover which represents a costly and impractical way of manufacturing. Furthermore due to the pressures applied to the footbed material in active isolated stretching the separate fabric cover would not be durable enough over time.

The two methods of securing a rope end to the inside of a handle work well for the diameter or gauge of rope used for a jump rope as disclosed in the two sighted patents below but would be unsuitable for larger diameter cords or ropes of ½" to 1" is the practical size for the stretching rope as disclosed in this invention. Tying a knot in a rope of ½" to 1" in diameter would necessitate the use of a large handle or cap to house the tied rope end. This would make the ends of the stretch rope very large and out of proportion to the rest of the rope. The use of a crimp end for ½" to 1" diameter rope has been explored for this stretch rope application. The cost of a large crimp, assembly procedure and overall look make the use of such a device impractical for the manufacture of this invention.

In U.S. Pat. No. 4,293,125 (1981) Hinds discloses a cord or rope end which is placed through a jump rope handle end. The said cord is tied into a knot to prevent the cord from pulling through the handle.

In U.S. Pat. No. 4,563,002 (1986) Jardine discloses a rope end which is placed through a jump rope handle end. A metal sleeve is then crimped on the end of the rope to prevent it from pulling through the handle.

The use of handles on the rope ends in this stretching rope invention is not generally required for most of the stretches as the user mainly grips the stretching device along various areas of the rope. However, another object of this invention is to provide a means to permanently attach handles and or end caps to the ends of the stretching rope to give the final product a finished cosmetic look and firm grip area when needed.

DETAILED DESCRIPTION OF THE INVENTION

The substance of this invention lies in the idea that when a rope is used in assisting the muscles in active isolated stretching there is sufficient force applied to the rope to cause major discomfort to the user in all areas of rope contact around the foot, feet, hands and the lower leg region. Many people that practice active isolated stretching choose to wear only socks during the stretches as opposed to athletic shoes. When socks are worn the likelihood of user discomfort to the base of the foot is inevitable.

Due to the round shape and smooth surface of the rope there is a propensity for the rope to roll off or simply change position on the foot, feet, hands or lower leg area when a pulling force is applied during use. When the rope moves and changes position on the foot the users ankle will also move which increases the chance of the rope rolling or slipping off the foot. When the rope moves out of position or off the foot or feet the stretching exercise must be interrupted to allow the user to reposition the stretch. Because each stretch is usually carried out in 2 sets of 8–12 repetitions the undesired rope movement is a major inconvenience.

The stretching device of this invention aims at correcting these deficiencies by addressing each specific concern mentioned above. Furthermore the intent is to be able to manufacture this device in an efficient and economical fashion. Therefore the stretching device in this invention features a soft footbed designed for cost efficient manufacturability, comfort, durability and sufficient flexibility to allow the user to position and wrap the footbed on and around the foot, feet, hands and lower leg area with ease. The footbed member contacts, compresses and forms to the foot, feet, hands or lower leg area due to the unique properties of the material and shape of the footbed.

Figure 1:
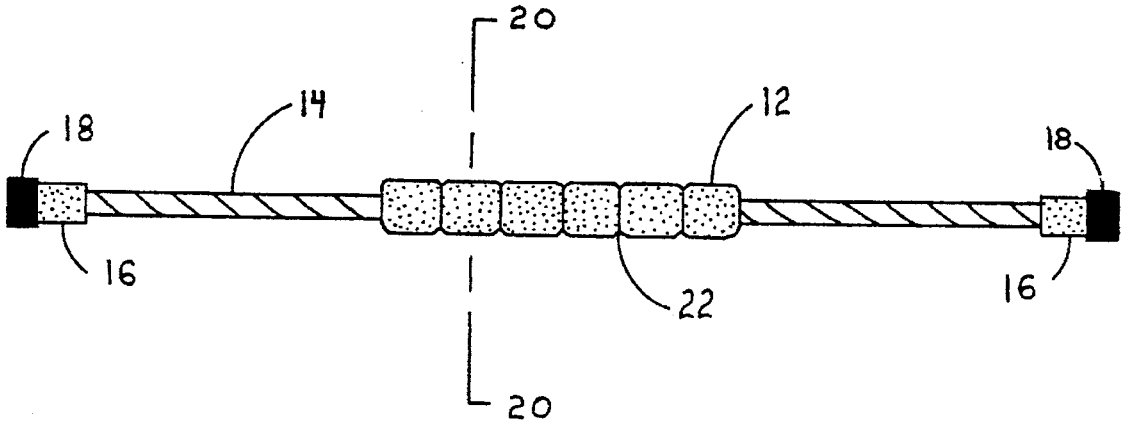
FIG. 1 is a perspective view of the preferred embodiment of the stretch rope according to this invention.
Figure 2:
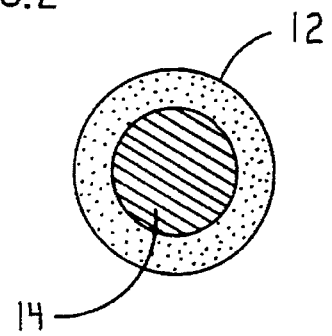
FIG. 2 is an enlarged section taken on lines 20—20 of FIG. 1 to show wall sections of rope, and soft pliable outer footbed member.
Figure 3:
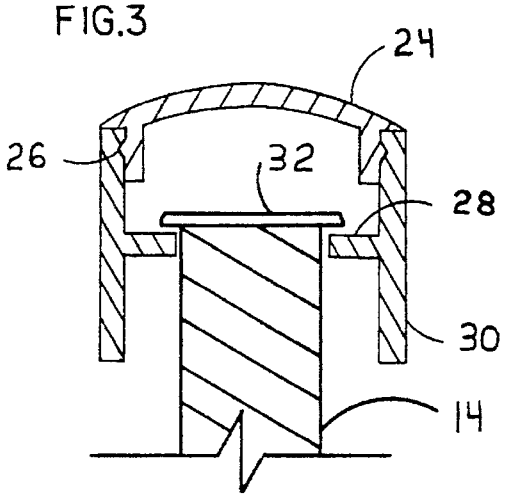
FIG. 3 is an enlarged cross section of the stretch rope cap end 18 as illustrated in FIG. 1, and one end portion of the stretch rope which has been flared outward at the extreme end.

FIG. 1 illustrates an example of a stretch rope according to this invention. Viewed from the side, it shows a stretch rope device that includes a footbed 12, a rope 14, handle ends 16, and end caps 18. FIG. 2 illustrates a section taken on lines 20—20 of the rope 14, and the footbed foam member 12. FIG. 3 illustrates a cross section of the end cap 18.

The rope 14 as shown in FIGS. 1 and 2 may be comprised of a single piece of braided or twisted rope. Finally the rope may be fabricated with any suitable materials known in the art, with the requirement that it is smooth, pliable and does not elongate to a great extent when a pulling force is applied. The footbed 12 as shown in FIGS. 1 and 2 consists of single piece of durable foam which has been shaped by a cutting wheel. The footbed 12 is constructed with a soft plastic elastomeric durable foam which will compress and flex when moderate force is applied. The two suggested foam materials for this application are CPE/EPDM foam (chlorinated polyethylene monomer/ethylene propylene diene monomer) or straight EPDM foam (ethylene propylene diene monomer).

The footbed material must be comfortable to the user and provide secure positioning on the users foot, feet, hands or lower leg area. This material once compressed will stay in place on the base of the users foot, feet, or lower leg area and will not irritate the contact area of the users body when a pulling force is applied due to the yielding characteristics of the material. In addition the foam footbed 12 must be flexible enough to allow the user to place it at the bottom of the feet and wrap around the lower leg area. The degree that the footbed flexibility required is achieved by a combination of the use of a soft flexible foam material and the repeating grooves 22 which are cut into the walls of the footbed that add to the yielding characteristics of the footbed when the rope 14 and footbed 12 are pulled by the user to assist in various stretches.

The footbed 12 is extruded from a single piece of extruded closed or open cell EPDM or CPE/EPDM foam tubing has a length of about twelve to forty inches and has a solid pliable outer skin which is later removed. In a separate operation the skin is abraded away or cut with a abrasive cutting wheel which exposes the foam cells. Exposing the cells gives the surface of the tubing a soft tactile surface. Furthermore during the cutting process the tubing is shaped and contoured. This is done by designing the abrasive cutting wheel used to cut or abrade the tubing to the specific desired profile of the final footbed design. For this particular invention the abrasive cutting wheel is designed to cut and form repeating vertical grooves 22 into the wall of the tubing. The grooves 22 allow the footbed 12 to have much greater flexibility when slight pressure is applied to the surface. This enables the user to easily wrap the footbed around the foot, feet or lower leg area.

The inner diameter of the footbed tubing is very close in size to that of the rope diameter. This allows the inner wall of the footbed 12 to form fit to the outside diameter of the rope 14. The intimate contact of the footbed 12 to the rope 14 prevents horizontal movement of the footbed along the rope during use and provides the user with firm contact of the footbed to the rope when pressure is applied. This form fitting design prevents the footbed 12 from being pinched, crimped, stretched out, or elongated when a pulling pressure is applied by the users feet or hands during use. This design feature makes the footbed 12 much more durable by preventing over stretching or tearing. In addition the intimate contact of the footbed to the rope eliminates the need for clamps or crimps to be placed on the ends of the footbed to keep it from moving out of the centrally assembled position on the rope.

To achieve the intimate contact and the form fitting results of the inner wall of the footbed 12 to the outer wall of the rope 14 two assembly methods can be used. Both of these methods provide an economical way to assemble the footbed 12 to the rope 14 and eliminate the need for a double wall tube comprising a pre-assembled inner rigid tubing to aid in installation. The first method of assembly involves the use of a non-toxic water base lubricant which is applied to the inside wall of the footbed 12 which has been pre-shaped by the cutting wheel. The rope 14 is then inserted and gently twisted through the inside diameter of the foam tubing footbed 12 until it is centrally located on the length of rope. The second method involves placing the foam footbed 12 inside a piece of rigid tubing used for assembling the footbed onto the central location of the rope 14 which has a larger inside diameter than the outside diameter of the footbed.

The rigid tube used to facilitate this assembly is hooked up to a vacuum line from which a vacuum is drawn that pulls the outside walls of the foam tubing towards the inside walls of the rigid tube. The ends of the footbed tube are sealed temporally around the ends of the rigid plastic assembly tube during the vacuum stage so the proper vacuum pressure can be reached between the outside footbed wall and the inside rigid plastic tube. When the vacuum is turned on the inside diameter of the footbed 12 increases in size by the negative pressure and it is drawn outward towards the walls of the larger inside diameter rigid assembly tube. The rope can now be fed through the inside diameter of the foam footbed tube walls with ease. Once the footbed is centrally located on the rope the vacuum is turned off which allows the inside wall of the footbed 12 to collapse back to its original size and form fit to the outside wall of the rope.

Referring to FIGS. 1, 2, and 3 illustrating a particular embodiment of this invention is shown. Like parts in various figures of the drawings are identified with the same reference symbols. While only one of many ways to effect the same result, the apparatus in these figures is believed to be the best example of for manufacturing the invention in an economical and efficient way.

FIG. 1 illustrates an example of a stretch rope according to this invention. Viewed from the side, it shows a stretch rope device that includes a footbed 12, a rope 14, handle ends 16 and end caps 18. FIG. 2 illustrates a section taken on lines 20—20 of the rope 14 and the footbed foam member 12. FIG. 3 illustrates a cross section of the end cap 18.

The rope 14 as shown in FIGS. 1 and 2 may be comprised of a single piece of braided or twisted rope. Finally the rope may be fabricated with any suitable materials known in the art, with the requirement that it is smooth, pliable and does not elongate to a great extent when a pulling force is applied. The footbed 12 as shown in FIGS. 1 and 2 consists of single piece of durable foam which has been shaped by a cutting wheel. The footbed 12 is constructed with a soft plastic elastomeric durable foam which will compress and flex when moderate force is applied. The two suggested foam materials for this application are CPE/EPDM foam (chlorinated polyethylene monomer/ethylene propylene diene monomer) or straight EPDM foam (ethylene propylene diene monomer). The footbed material must be comfortable to the user and provide secure positioning on the users foot, feet, hands or lower leg area. This material once compressed will stay in place on the base of the users foot, feet or lower leg area and will not irritate the contact area of the users body when a pulling force is applied due to the yielding characteristics of the material. In addition the foam footbed 12 must be flexible enough to allow the user to place it at the bottom of the feet and wrap it around the lower leg area. This degree the footbed flexibility required is achieved by a combination of the use of a soft flexible foam material and the repeating grooves 22 which are cut into the walls of the footbed that add to the yielding characteristics of the footbed when the rope 14 and footbed 12 are pulled by the user to assist in various stretches. Handles 16 and end caps 18 are attached to the ends of the rope 14 to give the final product a finished cosmetic commercial look. The end cap and handle ends are not directly pulled by the user during the majority of the stretches. The handles 16 can be manufactured from the same foam material used for the footbed 12.

Handles 16 and end caps 18 are attached to the ends of the rope 14 to give the final product a finished cosmetic commercial look. The end cap and handle ends are not directly pulled by the user during the majority of the stretches. The handles 16 can be manufactured from the same foam material used for the footbed 12. The installation of the handles 16 to the rope 14 can be accomplished by using the same techniques as discussed for the footbed 12 installation on the rope 14. Due to the shorter length of the handles when compared to the footbed it is also possible to push and twist the handles over the rope ends without the methods described for the footbed installation.

End caps 18 as shown in FIG. 1 are permanently attached to each end of the rope 14 to prevent the handles 16 from pulling off the two ends of the rope. To utilize the design features of this special end cap the rope should be manufactured from plastic material fibers such as polypropylene, polyethylene or nylon. As one of the first steps in the assembly process the rope is cut to length with a hot cut knife Which melts the rope ends to prevent unraveling. After the footbed 12 and handles 16 are assembled onto the rope 14 the rope ends are fed into the bottom opening of the end cap past the end cap wall step 28 and through the top of the cap. It should be noted that at this stage of assembly the end cap top 24 has not been installed. The rope end is now heated to the plastic fiber melting temperature and flared outward by pressing the heated softened edge on a flat smooth surface creating a plastic lip around the extreme end of the rope 32. The said flared rope end once cooled prevents the rope from being pulled through or past the internal wall shoulder 28 of the end cap 18.

The final step involves pulling the rope end 32 against the end cap wall step 28 until the two surfaces meet. The end cap top 24 is then installed by pushing the said end cap top into the end cap opening until the end cap top snap feature 26 snaps into place against the snap feature 26 on the end cap body.

I claim:

1. A rope stretching apparatus consisting of:

(a) an elongated rope having an outer diameter of about ½ to one inch, and constructed from woven plastic fibers;

(b) a footbed constructed from a single piece of extruded hollow foam tubing having a length of about twelve to fourty inches, and having an inner diameter slightly larger than the outer diameter of said rope, said footbed centrally located on said rope;

(c) a pair of foam rope end handles attached to the ends of said rope, each handle having a length of about two to six inches;

(d) molded plastic end caps each having a hollow structure and inner shoulders which protrude from the inner wall thereof, said shoulders defining a diameter slightly larger than the rope diameter; a recessed groove molded at one end of said end caps, wherein each rope end is fed through a second end of each said end cap, the rope ends heated to produce a flared end for preventing the rope ends from disconnecting from said end caps;

(e) plastic snap caps locked into a respective end groove for sealing the first ends of said end caps;

whereby the footbed is used as a foot sling to hold and move the foot of the user while holding and pulling said rope and handles.

2. The apparatus of claim 1 wherein said footbed consists of a plurality of of radial grooves cut along the length of said footbed for increasing the flex properties of said footbed.

* * * * *